US008961699B2

(12) United States Patent
Classen et al.

(10) Patent No.: US 8,961,699 B2
(45) Date of Patent: Feb. 24, 2015

(54) METHOD FOR OPERATING A WATER-CONDUCTING DOMESTIC APPLIANCE

(75) Inventors: Egbert Classen, Wertingen (DE); Michael Fauth, Pleinfeld (DE); Caroline Heiligenmann, Boeblingen (DE); Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/311,092

(22) PCT Filed: Aug. 29, 2007

(86) PCT No.: PCT/EP2007/058990

§ 371 (c)(1),
(2), (4) Date: Mar. 18, 2009

(87) PCT Pub. No.: WO2008/034696

PCT Pub. Date: Mar. 27, 2008

(65) Prior Publication Data

US 2009/0314313 A1 Dec. 24, 2009

(30) Foreign Application Priority Data

Sep. 19, 2006 (DE) ..... 10 2006 043 914

(51) Int. Cl.

| | |
|---|---|
| ***B08B 9/20*** | (2006.01) |
| ***A47L 15/44*** | (2006.01) |
| ***A47L 15/42*** | (2006.01) |

(52) U.S. Cl.

CPC ..... *A47L 15/44* (2013.01); *A47L 15/4236* (2013.01)

USPC ..... 134/25.2; 134/26; 134/27; 134/28; 134/29; 134/56 R; 134/57 D; 134/57 DL; 134/57 R; 134/56 D; 134/58 R; 134/58 D; 134/58 DL

(58) Field of Classification Search

CPC ..... A47L 15/42; B08B 3/00; B08B 3/02; B08B 3/04

USPC ..... 134/25.2, 26–29, 56 R–58 DL

See application file for complete search history.

(56) References Cited

U.S. PATENT DOCUMENTS

| | | | |
|---|---|---|---|
| 3,370,597 | A | 2/1968 | Fox |
| 4,110,075 | A | 8/1978 | Graf et al. |

(Continued)

FOREIGN PATENT DOCUMENTS

| | | | |
|---|---|---|---|
| DE | 1977908 | U | 2/1968 |
| DE | 3525365 | A1 | 1/1987 |

(Continued)

OTHER PUBLICATIONS

Google Translation of WO 02/077353 A1.*

*Primary Examiner* — Bibi Carrillo

(74) *Attorney, Agent, or Firm* — James E. Howard; Andre Pallapies

(57) ABSTRACT

A method for operating a water-conducting domestic appliance, including a domestic dishwasher, wherein the water-conducting domestic appliance includes a program controller for performing a plurality of sequential program steps and the program controller operatively interacts with at least a detergent-dosing system, the method including the step of adding at least one cleaning substance having a function during at least one program step.

16 Claims, 1 Drawing Sheet

(56) References Cited

U.S. PATENT DOCUMENTS

| | | | | |
|---|---|---|---|---|
| 4,908,148 | A * | 3/1990 | Caravajal et al. | 510/514 |
| 5,094,771 | A * | 3/1992 | Ahmed et al. | 510/221 |
| 7,789,967 | B2 | 9/2010 | Classen et al. | |
| 2002/0028754 | A1 * | 3/2002 | Johansen et al. | 510/302 |
| 2002/0088502 | A1 | 7/2002 | Van Rompuy et al. | |
| 2004/0058846 | A1 * | 3/2004 | Kistenmacher et al. | 510/475 |
| 2005/0022314 | A1 * | 2/2005 | Ambuter et al. | 8/158 |
| 2006/0094634 | A1 * | 5/2006 | Jekel et al. | 510/446 |
| 2007/0144558 | A1 * | 6/2007 | Classen et al. | 134/18 |

FOREIGN PATENT DOCUMENTS

| | | | |
|---|---|---|---|
| DE | 4219620 | A1 | 12/1993 |
| EP | 0231843 | A2 | 8/1987 |
| WO | 02077353 | A1 | 10/2002 |
| WO | WO 02077353 | A1 * | 10/2002 |
| WO | WO 2005058126 | A1 * | 6/2005 |

* cited by examiner

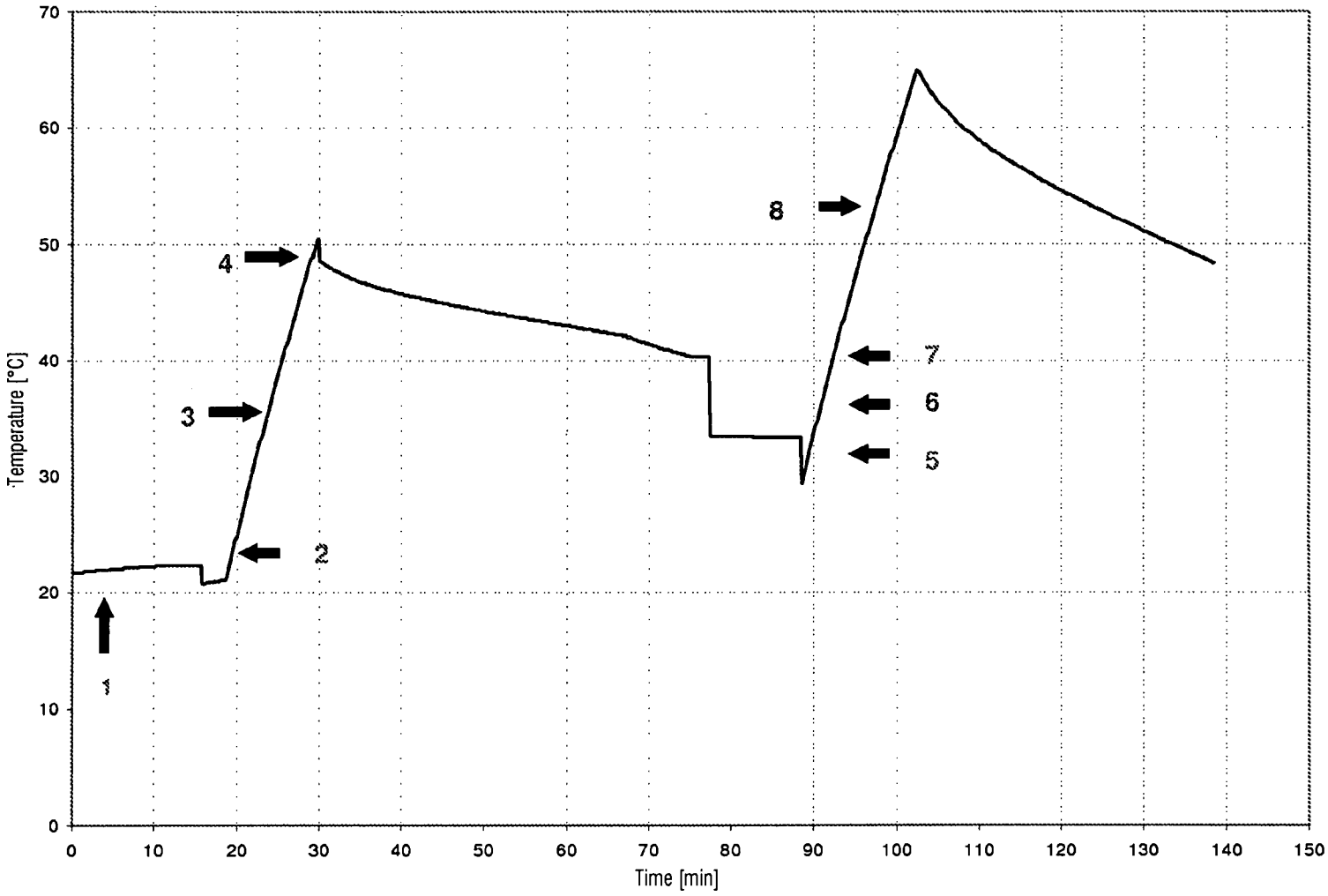
Temperature [°C]
70
60
50
40
30
20
10
0
Time [min]
0
10
20
30
40
50
60
70
80
90
100
110
120
130
140
150
1
2
3
4
5
6
7
8

METHOD FOR OPERATING A WATER-CONDUCTING DOMESTIC APPLIANCE

BACKGROUND OF THE INVENTION

The invention relates to a method for operating a water-conducting domestic appliance.

Dishwashing machines, in particular domestic dishwashers, usually possess for example a cleaning agent adding device disposed on the inside of the dishwasher door and a rinsing agent adding device which dispense their entire contents into the washing chamber of the dishwasher at a predetermined time during the execution of a wash program. In this case cleaning agents that are typically used are detergents in powder form which are composed of a plurality of cleaning substances, wherein each of the substances has a function, such as e.g. enzymes which can degrade starch, protein or fatty compounds, bleaching agents, bleach activators, dispersing and complexing agents, surfactants and alkali carriers. However, since the detergent in powder form is added all at once, all the active ingredients of the detergent in powder form are contained in the washing liquor from the time of being added. This, though, reduces the cleaning performance, since individual components mutually influence one another in a negative manner and consequently have a negative impact on the cleaning result. An alternative to the use of powdered cleaning agents are combination products in tablet form which are introduced into the washing chamber of a dishwasher before the start of a wash cycle. In this case the combination products in tablet form are embodied in such a way that the corresponding active components, such as e.g. cleaning agent, rinse aid, hardness binding agents, glass protector etc., are released at different times in accordance with the steps of a domestic dishwasher. In this case, however, the possible combinations and time sequences of active components are also limited. Furthermore, in the case of domestic dishwashers which have a quick-wash program with a running time of, for example, 30 min, there arises the problem that combination products in tablet form of the aforesaid type cannot completely dissolve during the program running time and consequently at the end of a washing cycle of said kind the glassware has unsightly staining due to water spotting.

BRIEF SUMMARY OF THE INVENTION

It is therefore the object of the invention to disclose a method for operating a water-conducting domestic appliance, in particular a domestic dishwasher, by means of which an optimized cleaning and drying result can be achieved with minimal use of chemicals.

The inventive method for operating a water-conducting domestic appliance, in particular a domestic dishwasher, wherein the water-conducting domestic appliance has a program controller for performing a plurality of sequential program steps and the program controller operatively interacts at least with a detergent-dosing system, is characterized according to the invention in that a dose of a cleaning substance having a function is added at least during one program step. No combination products are used which have a plurality of cleaning agent substances each having one function. In this way an interaction of a negative kind between individual cleaning substances is ruled out and consequently an improvement in the cleaning and drying result achieved.

It is preferably provided in this case that a plurality of cleaning substances, in particular 3 to 10, each having one function are added. In this case the cleaning substances can be alkali carriers which cause accumulations of soiling to swell up. This improves the action of added enzymes and at the same time permits coarse forms of soiling to be removed. In addition, dispersing and/or complexing substances can be supplied which reduce the hardness of the water by complex formation. In addition, other metal ions are also neutralized owing to the complex formation. Furthermore, enzymes breaking down proteins and/or peptides (albumen), enzymes breaking down starch compounds and/or polysaccharides, such as, for example, amylase, and enzymes breaking down fatty compounds, such as, for example, lipase, can be added. Surfactants, in particular non-ionic surfactants which positively assist the dispersing action, can also be added. Finally, bleaching agents, such as, for example, hydrogen peroxide, can also be added in addition to a bleach activator, the effect of the bleach activator being that it significantly enhances the action of bleaching agents, such as, for example, hydrogen peroxide, even at temperatures of less than 80° C.

In this case it is preferably provided that at least two cleaning substances are added during one program step. This permits, for example, the water hardness to be optimized before each program step and then a further dose of cleaning substance to be added.

It is preferably provided in this case that at least two cleaning substances are added, such as e.g. a bleaching agent, such as e.g. hydrogen peroxide, and a bleach activator in order thereby to optimize the action of the added cleaning substance.

Furthermore, it is preferably provided that at least a first enzyme and a second enzyme having different functions are added one after the other separated by a time interval. This permits the sequential use of enzymes such as, for example, protease and amylase which, if added simultaneously, would each negatively affect the action of the other.

In this case it is preferably provided that an enzyme breaking down starch compounds and/or polysaccharides is added as the first enzyme. The enzyme is amylase.

Furthermore, it is preferably provided that an enzyme breaking down protein and/or lipids, such as, for example, protease, is added as the second enzyme.

It will furthermore be provided that an enzyme breaking down fatty compounds, such as e.g. lipase, will be added as a further enzyme.

It is preferably provided therein that first the first enzyme and a dispersing and complexing substance will be added. This ensures that starch compounds and/or polysaccharides will be broken down first by means of the first enzyme, and the water hardness optimized by the addition of a dispersing and complexing substance, thereby optimizing the action of the first enzyme.

In a preferred development of the method it is provided that the pH value will be increased at least after addition of the second enzyme. This can be achieved for example by the addition of an alkali carrier, such as e.g. sodium hydroxide. This produces a better swelling-up, with the result that enzymes act more effectively, and at the same time provides improved glassware protection.

In a preferred development of the method according to the invention it is provided that at least one bleaching agent will be added. The bleaching agent can be hydrogen peroxide. The bleaching agent is added after a time interval with respect to the addition of enzymes, e.g. in different program steps, in order thereby to avoid an interaction that negatively impacts on their effectiveness.

Since hydrogen peroxide delivers its optimal effect as a bleaching agent only from temperatures of approx. 80° C., it is preferably provided that a bleach activator is added.

Furthermore, it is preferably provided that at least alkaline earth ions are at least partially complexed. This can be achieved by the addition of a dispersing and/or complexing substance, with the result that an optimally set water hardness for maximum action of the cleaning substances will be provided at each program step. Alternatively or in addition, an ion exchanger or another water softening apparatus or method can be used.

In a preferred embodiment it is provided that the plurality of program steps will be executed under program control. In other words, from a plurality of wash programs provided that combine a plurality of program steps having different parameters, an operator will select one program which will then be executed by a control device of a dishwasher. In this case the individual cleaning substances will be dispensed in accordance with predefined dosing quantities.

In a preferred development it is provided that at least one program step executes under sensor control. For example, the dosing can be adjusted by means of turbidimetry or conductivity measurement.

In a preferred embodiment, a program step "Pre-wash" is provided in which an alkali carrier and a dispersing substance are added. The two substances can be dosed simultaneously or one after the other separated by a time interval.

In a preferred development it is provided that an enzyme and/or a surfactant are/is added in addition in the program step "Pre-wash". The enzyme can be protease, amylase or lipase, while the surfactant can be in particular a non-ionic surfactant. In this case too the substances can be dosed simultaneously or one after the other separated by a time interval.

In a further preferred embodiment a program step "Clean" is provided in which an alkali carrier, a dispersing and/or complexing substance and at least two enzymes are added separated by time intervals. The components can again be dosed simultaneously or one after the other separated by time intervals, in the case of the alkali carrier and dispersing and/or complexing substance. On the other hand, the two enzymes, for example protease and amylase, must be added one after the other separated by a time interval, since the protease negatively affects the action of the amylase.

In a preferred development it is provided that in addition an adipolytic enzyme and/or a surfactant are/is added. In this case lipase, for example, will be added as the adipolytic enzyme, and as the surfactant a non-ionic surfactant for improving the dispersion action. In this case the surfactant can be added at the same time as another component or subsequently separated by a time interval.

In a further preferred embodiment a program step "Intermediate wash" is provided in which alkali carriers and a dispersing substance are added. The dosing can take place simultaneously or sequentially separated by time intervals. In this case the addition of alkali carrier in the program step "Intermediate wash" permits a preparatory stage for removing tea stains by means of a bleach, since a specific pH value must be reached for an optimal removal of tea stains.

Finally, according to a preferred development a program step "Rinse" is provided in which a dispersing and/or complexing substance, a bleaching agent, a bleach activator and a surfactant are added. In this case the addition of the dispersing and/or complexing substance causes the water hardness to be reduced as a result of complex formation and metal ions to be likewise complexed, thereby facilitating for example the removal of e.g. tea stains. The dosing of the dispersing and/or complexing substance can take place simultaneously with or separated by a time interval from other components. The removal of tea stains or tea scum is achieved by the addition of a bleaching agent, such as, for example, hydrogen peroxide. In this case bleaching agents are added separately from enzymes, preferably in the final program step. Apart from the addition of enzymes, the bleaching agent can be added simultaneously with any other component.

In this case the bleach activator promotes the bleaching action of hydrogen peroxide at temperatures of less than 80° C., with the result that an optimal bleaching action is possible by means of hydrogen peroxide as the bleaching agent even at the temperatures that are usual during the operation of a dishwasher. The dosing of the bleach activator can take place together with the dosing of the bleaching agent or separately therefrom after a time interval. The adding of a surfactant, for example a non-ionic surfactant, effects a rinsing action by reducing the surface tension of the water. Said component can be dosed simultaneously with another component or separately therefrom after a time interval.

It is preferably provided in this case that an alkali carrier is added in the program step "Rinse". The alkali carrier can be sodium hydroxide, the addition of sodium hydroxide resulting in an adjustment in the pH value and effecting an improved action of bleaching agents for the removal of e.g. tea stains.

In a preferred development of the method it is provided that a program step "Disinfect" is provided. This permits the development of unpleasant odors which can be produced when dishes are collected in a dishwasher for days to be counteracted. Said odors are caused by the degradation products of microorganisms which form in a dishwasher. This is the case in particular at high temperatures, such as in summer.

In this case it is preferably provided that a biocidal fluid is added. Possible fluids here are biocides which act against bacteria (bactericides), fungi (fungicides), microbes (microbicides), viruses (virucides) and also algae (algicides), said biocides counteracting the settlement and possible formation of biofilms and thereby preventing unpleasant odors from developing during extended periods of non-operation.

Finally, it can preferably be provided that a corrosion inhibitor, in particular a glass-protecting corrosion inhibitor which counteracts glass corrosion, will be added in at least one program step. It is preferably provided therein that the corrosion inhibitor contains at least zinc salt. Other suitable corrosion inhibitors can also be used, however.

The corrosion inhibitors are preferably added in a program step "Clean" and/or "Rinse", but this can also be done during other program steps, such as e.g. during an intermediate wash step. In this case it is preferably provided that the corrosion inhibitor is added after a time interval with respect to the increase in the pH value, in particular through the addition of sodium hydroxide, and/or with respect to the addition of at least one enzyme and/or with respect to the addition of a complexing substance.

BRIEF DESCRIPTION OF THE DRAWINGS

The invention is explained below with reference to an exemplary embodiment. The single FIGURE shows:

a schematic representation of a temperature profile of a wash program having a plurality of dosing points.

DETAILED DESCRIPTION OF THE PRESENT INVENTION

The FIGURE shows a temperature profile of a normal wash program of a domestic dishwasher comprising the steps "Pre-wash", in which washing liquor is circulated without being heated, "Clean", in which the washing liquor is heated to approx. 50° C. and follows on after the washing phase, a step "Intermediate wash", in which washing liquor is circulated without being heated, and a step "Rinse", in which the washing liquor is heated to approx. 65° C.

According to the exemplary embodiment, sodium hydroxide is added as an alkali carrier during the pre-wash together with a dispersing and/or complexing substance in a step 1 in order thereby to cause soiling to swell up so that the cleaning action of subsequent enzymes will be improved and the alkaline earth ions affecting the water hardness will be complexed.

This is followed by the cleaning phase, at the start of which the enzyme amylase, for breaking down starch compounds and/or polysaccharides (sugar compounds), is added in step 2. After a time interval, approx. 5 min later for example, the enzyme protease is added in step 3 in order to break down proteins and/or peptides (protein compounds).

Finally, as the last operation in a step 4, sodium hydroxide is added as an alkali carrier at a temperature of approx. 50° C. in order to increase the pH value of the washing liquor, thereby improving the action of enzymes during the following post-wash phase.

An intermediate wash phase follows, in which washing liquor is circulated without being heated.

The final step is a rinse phase in which the washing liquor is heated to approx. 85° C. In a step 5 a dispersing and/or complexing substance is added in order to complex ions, in particular alkaline earth ions, and at the same time, by means of said complexing of metal ions, to facilitate the dissolution of soiling, such as tea stains for example. Immediately following this, in a step 6, hydrogen peroxide is added as a bleaching agent, and in a step 7 a bleach activator is added in order to optimize the action of hydrogen peroxide as a bleaching agent also at temperatures below 80° C. Finally, in a step 8, a non-ionic surfactant is added in order to ensure, by reducing the surface tension, a residue-free drying process so that for example no dry edges remain on glasses.

This is followed by the drying process for the dishes.

A biocidal fluid can be added as a program step of a cleaning program or also as an individual step initiated manually by an operator. In particular, biocides to counteract bacteria (bactericides), fungi (fungicides), microbes (microbicides), viruses (virucides) and also algae (algicides) can be added in order thereby to prevent unpleasant odors from developing during extended periods of non-operation.

There are various possibilities for dosing. For example, substances can be added at the end of the rinse cycle in order to disinfect the water remaining in the sump or in the pipes. The formation of biofilms can be prevented in this way. Alternatively, an extra hygiene rinse program can be provided which is performed automatically at predetermined intervals or initiated manually by an operator as necessary. During the hygiene program the machine is filled with approx. 3 l water and sufficient biocidal agent is added. The liquor containing the biocidal agent is then circulated. In addition other substances, such as e.g. dispersing and complexing substances, can also be added to improve the effectiveness of the operation. To supplement this, a circulating pump can be operated at a reduced speed only, with a water diverter being simultaneously closed so that only a small amount of washing liquor is discharged from spray arms. In this way only the pipes and the pump sump are cleaned.

Furthermore, a corrosion inhibitor, in particular a glass-protecting corrosion inhibitor which counteracts glass corrosion and contains, for example, zinc salt can be added in at least one program step.

The corrosion inhibitor is added in a program step "Clean" and/or "Rinse", or also during another program step, such as e.g. during an intermediate wash step. The corrosion inhibitor is added after a time interval with respect to the increasing of the pH value, in particular by the addition of sodium hydroxide, and/or with respect to the adding of at least one enzyme and/or with respect to the adding of a complexing substance.

The invention claimed is:

1. A method for operating a water-conducting domestic appliance, wherein the water-conducting domestic appliance includes a program controller for performing a plurality of sequential program steps and the program controller operatively interacts with at least a detergent-dosing system, the method comprising a first program step including a cleaning phase in which an alkali carrier together with at least one of a first dispersing substance and a first complexing substance are added, the cleaning phase including at least two enzymes added at times separated by a time interval, the method comprising a second program step of clear rinsing in which at least one of a second dispersing substance and a second complexing substance are added, and after adding the at least one of the second dispersing substance and the second complexing substance, a bleach, a bleach activator and a surfactant are added in separate applications.

2. The method according to claim 1 wherein at least one of the at least two enzymes is operable to break down at least one of starch compounds and polysaccharides.

3. The method according to claim 1 wherein at least one of the at least two enzymes is operable to break down at least one of proteins and peptides.

4. The method according to claim 1 wherein at least one of the at least two enzymes is operable to break down fatty compounds.

5. The method according to claim 1 further comprising adding at least partially complex alkaline earth ions.

6. The method according to claim 1 wherein at least one program step is executed under sensor control.

7. The method according to claim 1 wherein the first program step includes a pre-wash program step, which comprises adding at least one of the at least two enzymes and a surfactant.

8. The method according to claim 1 wherein the method includes an intermediate wash program step wherein another alkali carrier and at least one of another dispersing substance and another complexing substance are added.

9. The method according to claim 1 wherein the clear rinsing program step includes adding an additional alkali carrier.

10. The method according to claim 1 wherein the method includes a disinfecting program step.

11. The method according to claim 1 wherein the first program step includes adding a biocidal fluid.

12. The method according to claim 1 wherein at least one of the first program step and second program step includes adding a glass-protecting corrosion inhibitor.

13. The method according to claim 12 wherein the first program step includes adding the glass-protecting corrosion inhibitor containing at least zinc salt.

14. The method according to claim 12 wherein the second program step includes adding the glass-protecting corrosion inhibitor.

15. The method according to claim 12 wherein the alkali carrier in the first program step is sodium hydroxide, which functions to increase a pH value, and wherein the first program step includes adding the glass-protecting corrosion inhibitor after a time interval with respect to adding the sodium hydroxide, adding the at least two enzymes, and adding the first complexing substance.

16. A method for operating a water-conducting domestic appliance, wherein the water-conducting domestic appliance includes a program controller for performing a plurality of sequential program steps and the program controller operatively interacts with at least a detergent-dosing system for adding materials to a wash liquor, the method comprising:

adding, in a pre-wash phase, an alkali carrier together with at least one of a first dispensing substance and a first complexing substance to the wash liquor, then performing a cleaning phase in three stages, wherein a first stage comprises adding an enzyme amylase, a second stage, after a first time interval from the first stage, comprises adding an enzyme protease, and a third stage, after a second time interval from the second stage, comprises adding a second alkali carrier; then circulating the wash liquor in a wash phase; and then performing a rinse phase in multiple stages including adding at least one of a second dispensing substance and a second complexing substance, then subsequently adding a bleaching agent, then subsequently adding a bleach activator, and then subsequently adding a non-ionic surfactant.

* * * * *